US011408112B2

(12) United States Patent
Lv et al.

(10) Patent No.: US 11,408,112 B2
(45) Date of Patent: Aug. 9, 2022

(54) WASHING ADDITIVE BOX AND WASHING MACHINE

(71) Applicant: QINGDAO HAIER DRUM WASHING MACHINE CO., LTD., Shandong (CN)

(72) Inventors: Peishi Lv, Shandong (CN); Baozhen Cheng, Shandong (CN); Tao Huang, Shandong (CN)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 247 days.

(21) Appl. No.: 16/606,169

(22) PCT Filed: Apr. 17, 2018

(86) PCT No.: PCT/CN2018/083263
§ 371 (c)(1),
(2) Date: Oct. 17, 2019

(87) PCT Pub. No.: WO2018/192457
PCT Pub. Date: Oct. 25, 2018

(65) Prior Publication Data

US 2020/0123692 A1 Apr. 23, 2020

(30) Foreign Application Priority Data

Apr. 17, 2017 (CN) ..... 201710248454.4
Apr. 17, 2017 (CN) ..... 201710248532.0
(Continued)

(51) Int. Cl.
*D06F 39/02* (2006.01)

(52) U.S. Cl.
CPC ..... *D06F 39/022* (2013.01)

(58) Field of Classification Search
CPC ..... D06F 39/022
(Continued)

(56) References Cited

FOREIGN PATENT DOCUMENTS

CN 2292106 Y 9/1998
CN 1749473 A 3/2006
(Continued)

OTHER PUBLICATIONS

EP2442922B1—machine translation (Year: 2010).*
(Continued)

*Primary Examiner* — Tinsae B Ayalew
(74) *Attorney, Agent, or Firm* — Buchanan, Ingersoll & Rooney PC

(57) ABSTRACT

A detergent additive box includes a closed box body having a cavity inside, wherein a liquid outlet and a unidirectional ventilation structure and a liquid outlet device are formed in the box body, the liquid outlet communicates with a draining pipeline of a washing machine to drain a detergent additive into a washing cavity of the washing machine; the unidirectional ventilation structure balances air pressures inside and outside the detergent additive box; and the liquid outlet device is arranged at the liquid outlet. The detergent additive is stored in the cavity of the box body, and the detergent additive enters the draining pipeline of the washing machine from the detergent additive box through the liquid outlet device. Air in the detergent additive box is circulated unidirectionally to balance the air pressure in the detergent additive box.

4 Claims, 4 Drawing Sheets

(30) Foreign Application Priority Data

Apr. 17, 2017 (CN) ..... 201710248560.2
Apr. 17, 2017 (CN) ..... 201710248603.7

(58) Field of Classification Search
USPC ..... 68/17 R
See application file for complete search history.

(56) References Cited

FOREIGN PATENT DOCUMENTS

| | | | | |
|---|---|---|---|---|
| CN | 201410441 | Y | 2/2010 | |
| CN | 202273112 | U | 6/2012 | |
| CN | 102899855 | A | 1/2013 | |
| CN | 203334042 | U | 12/2013 | |
| CN | 104495057 | A | 4/2015 | |
| CN | 105752469 | A | 7/2016 | |
| CN | 205689832 | U | 11/2016 | |
| CN | 106222957 | A | 12/2016 | |
| CN | 106283528 | A | 1/2017 | |
| CN | 106436188 | A | 2/2017 | |
| CN | 107130403 | A | 9/2017 | |
| CN | 107815819 | A | 3/2018 | |
| EP | 2442922 | B1 * | 5/2016 | ..... B08B 3/026 |
| KR | 101010683 | B1 | 1/2011 | |
| WO | 2013114106 | A1 | 8/2013 | |

OTHER PUBLICATIONS

EP2442922B1—machine translation (Year: 2016).*
International Search Report and Written Opinion (with English translations) issued in corresponding International Patent Application No. PCT/CN2018/083263, 18 pages (dated Jul. 20, 2018).
Extended European Search Report dated Jan. 20, 2020, issued in corresponding European Application No. 18787465.6. (8 pages).
Office Action dated Apr. 13, 2020, in corresponding Chinese Patent Application No. 201710248532.0. (4 pages).
Office Action dated Apr. 27, 2020, in corresponding Chinese Patent Application No. 201710248454.4. (4 pages).
Office Action dated Aug. 5, 2020, in corresponding Chinese Patent Application No. 201710248603.7. (4 pages).

* cited by examiner

WASHING ADDITIVE BOX AND WASHING MACHINE

TECHNICAL FIELD

The present disclosure relates to a detergent additive box and a washing machine, and particularly relates to a detergent additive box capable of cooperating with a washing machine to realize automatic drainage, multi-time drainage and sealing, balance of air pressures in the box and smooth drainage, and a washing machine using the detergent additive box.

BACKGROUND

By a conventional washing machine, it is necessary for a person who washes clothes to determine a manual adding amount of a detergent additive based on experience before the start of the washing, which increases the workload of the person, and which also easily causes that the clothes are not cleaned or causes waste due to improper control of the amount of the detergent additive. Therefore, an automatic drainage technology of the detergent additive is provided in the related art. The detergent additive and a softener for washing for multiple times are poured into a detergent additive distributor box, and are automatically drained as needed at each time of washing. There are also other different detergent additive boxes in the detergent additive distributor box.

The detergent additive box for containing the detergent additive and the softener is generally a sealed box body at present, and the detergent additive is quantitatively pumped out from the box by a Venturi effect or a negative pressure effect or through a metering pump, and the like.

At present, there are a large number of patent applications related to detergent automatic draining devices. The Chinese Patent Application No. 97208723.0 discloses a detergent draining device of a washing machine. An accommodating cavity matched with a bottle is arranged on a washing machine case body. A conical through hole is formed in the bottom of the accommodating cavity. A vertical fixing sheet is fixed on the through hole, and fixes a detergent guide pipe. A bottle body is matched with the accommodating cavity. A conical introduction pipe is arranged at a bottle neck. A ventilation port is formed in the bottom of the bottle body. This structure cannot control the adding amount of a detergent and is easy to damage, thus wasting the detergent.

The Chinese Patent Application No. 201610797034.7 discloses a detergent draining device of a washing machine. The detergent draining device includes: a storage cavity, in which a special detergent box placing slot is defined. A first ejector pin and a second ejector pin which are used for puncturing a special detergent box are arranged in the special detergent box placing slot. Furthermore, the first ejector pin has a water inlet hole inside, and the second ejector pin has a water outlet hole inside. The first ejector pin and the second ejector pin are configured to puncture into the special detergent box from the end portion to allow the water inlet hole and the water outlet hole to communicate with an internal space of the special detergent box. In this disclosure, washing water enters the detergent box through the water inlet hole and is mixed with the detergent, and then flows out through the water outlet hole into the washing machine. The detergent box can be used only once, and a new detergent box needs to be mounted at each time of washing. This causes a waste of resources, and brings a big trouble to customers in matching detergent additive boxes.

In addition, as the detergent additive is pumped out, the air pressure in the sealed detergent additive box becomes lower and lower, which makes the detergent additive flow out more and more difficultly, so that a ventilation structure is needed to balance the air pressure in the detergent additive box. Meanwhile, outflow of the detergent additive from the box due to toppling over, vibration and the like, and the phenomenon that external impurities and water enter the detergent additive box and pollute the detergent additive also need to be prevented.

In addition, after the detergent in the detergent box is drained into the washing machine, part of the detergent would be easily left on the bottom wall of the detergent box, thereby causing a waste and also bringing a great inconvenience to cleaning of the detergent additive box, a mounting cavity of the detergent additive box and the like.

In view of this, the present disclosure is provided.

SUMMARY

The technical problem to be solved by the present disclosure is to overcome the shortcomings in the prior art, and provides an unidirectional ventilation structure, a detergent additive box provided with a liquid inlet cover and a sealing structure, and a washing machine, so as to realize automatic drainage, multi-time drainage and sealing, balance of air pressure in the box and smooth drainage.

To solve the above-mentioned technical problems, the basic idea of the technical solution of the present disclosure is as follows.

An unidirectional ventilation structure, mounts on a carrier, and includes a ventilation element and an opening and closing element. An air vent is formed on the ventilation element. The opening and closing element includes an opening and closing portion. Changes of air pressures on two sides of the carrier open or close the opening and closing portion, the air vent implements unidirectional ventilation or is closed.

A detergent additive box is provided, including:

- a box body, which is a closed box body having a cavity inside, wherein a liquid outlet is formed in the box body, and the liquid outlet communicates with a draining pipeline of a washing machine to drain a detergent additive into a washing cavity of the washing machine;
- an unidirectional ventilation structure, used for balancing air pressures inside and outside the detergent additive box;
- a liquid outlet device, wherein the detergent additive stores the cavity inside the box body, and the detergent additive enters the draining pipeline of the washing machine from the detergent additive box through the liquid outlet device.

In the above solution, the detergent additive box is a sealed box body having the cavity inside, and is provided with the liquid outlet. The detergent additive is arranged in the cavity inside the box body. The draining pipeline of the washing machine communicates with the liquid outlet and pumps the detergent additive in the detergent additive box. The detergent additive enters the draining pipeline of the washing machine from the liquid outlet through the liquid outlet device. In the pumping process, the air pressures inside and outside the detergent additive box are balanced through the ventilation structure to keep the pumping smooth all the time.

Further, the unidirectional ventilation structure is arranged on the box body. The structure is opened to implement unidirectional ventilation or closed to seal the detergent additive box according to changes of air pressures inside and outside the detergent additive box.

In the above solution, the whole detergent additive box is a sealed box body, and the unidirectional ventilation structure only allows the box body to be ventilated unidirectionally, so that liquid, impurities and the like may not be circulated on two sides of the carrier through the unidirectional ventilation structure. The unidirectional ventilation structure ventilates unidirectionally and also plays a role of sealing the box body.

Further, an opening is formed in the box body, and the unidirectional ventilation structure is hermetically arranged in the opening.

The unidirectional ventilation structure includes a ventilation element and an opening and closing element. An air vent is formed in the ventilation element. The opening and closing element includes an opening and closing portion. Changes of air pressures inside and outside the box body of the detergent additive box open or close the opening and closing portion, the air vent implements unidirectional ventilation or is closed.

At least one air vent is formed in the ventilation element, and the air vent penetrates an upper end surface and a lower end surface of the ventilation element. Preferably, an air outlet of the air vent is uniformly distributed circumferentially on the lower end surface. The air vent is set to realize ventilation. The preferable uniformly-circumferential distribution of the air vent is to prevent such a situation that the air vent may not be reset and close, which due to an extremely large local opening degree of the opening and closing portion caused by non-uniform distribution of the air vent.

A connection hole connected to the opening and closing element and a ring groove assisted in sealing the opening and closing element are also arranged on the ventilation element. Preferably, the connection hole and the ring groove are coaxially arranged, and the air vents are uniformly circumferentially arranged around an axis of the connection hole, so as to prevent a failure, caused by non-uniform distribution of the air vents, in closing and resetting the opening and closing portion after the opening and closing portion is completely opened. A locking boss for clamping the opening and closing element is formed in the connection hole. The ring groove is formed in the lower end surface of the ventilation element. The air outlet of the air vent is formed in the lower end surface within the ring groove. Preferably, the inner side wall of the ring groove tilts towards the air vents. More preferably, the inner side wall of the ring groove extends to outer edges of the air vents in a tilting transition manner, thereby enhancing the sealing effect on the opening and closing portion.

The opening and closing element is an elastic material element, and includes the opening and closing portion and a connection portion. Preferably, the opening and closing element is an integrated molding elastic material element. The opening and closing portion of the opening and closing element is made of an elastic material, so that it correspondingly deforms under the action of certain pressure, and may restore the original shape after the pressure is removed. The opening and closing portion and the connection portion are in threaded connection or clasped connection or adhered connection or integrated molding. Preferably, they are integrated molding.

The opening and closing portion is of an inverted umbrella-shaped structure or an inverted conical structure, and the opening and closing portion covers the lower end surface of the ventilation element, and the tail end of the opening and closing portion extends into the ring groove. The opening and closing portion is set to be of the inverted umbrella-shaped structure or the inverted conical structure in order to make the opening and closing portion deform under certain unidirectional pressure and have higher restoring force thanks to its own structure after the deformation. When the opening and closing portion is closed, the tail end of the opening and closing portion extends into the ring groove to seal the air vent. When the opening and closing portion is opened, the opening and closing portion deforms, a tail end of the opening and closing portion leaves the ring groove, and the air vent implements unidirectional ventilation.

The connection portion is provided with a ring-form boss and a transition section. The ring-form boss cooperates with the locking boss in the connection hole to clamp the connection portion in the connection hole. The transition section is arranged between the ring-form boss and the opening and closing portion. A hollow hole for assisting the deformation of the opening and closing portion is arranged in the transition section. Preferably, the ring-form boss has a semicircular cross section in order to clamp the opening and closing element onto the locking boss of the connection hole more conveniently and quickly with less effort. Preferably, the hollow hole formed inside the transition section extends and passes through the opening and closing portion, so as to further reduce the force for the deformation of the opening and closing portion.

A detergent additive box includes a liquid outlet, and further includes the above-mentioned unidirectional ventilation structure. The detergent additive box has two states. In a first state, a detergent additive is pumped from the liquid outlet, so air pressure in the detergent additive box is reduced to be less than air pressure outside, and the opening and closing portion deforms, the tail end of the opening and closing portion leaves the ring groove, and air flows in through the air vent. In a second state, when the pumping is stopped, the liquid outlet is sealed, so air pressure in the detergent additive box is equal to the air pressure outside, and the opening and closing portion restores original shape, the tail end of the opening and closing portion extends into the ring groove to seal the detergent additive box.

Further, a detergent additive box with a liquid inlet cover includes a box body and a liquid inlet. The box body is provided with the liquid inlet. The liquid inlet cover is detachably and hermetically arranged at the liquid inlet. The liquid inlet cover is of an unidirectional ventilation structure.

In the above solution, an automatic draining detergent additive box on the current market is generally a one-off product and may not be repeatedly used. Meanwhile, the detergent additive box is sealed. As a detergent additive in the box body is pumped out, pressure in the box body becomes lower and lower, and it is more and more difficult to pump the detergent additive. Therefore, in the present disclosure, since the liquid inlet cover is detachably arranged on the box body of the detergent additive box, the liquid inlet cover may be detached immediately to supplement the detergent additive into the detergent additive box. Meanwhile, as the unidirectional ventilation structure, the liquid inlet cover seals the liquid inlet and may realize unidirectional ventilation at the same time.

The liquid inlet cover includes a cover body and an opening and closing element. At least one air vent is formed in the cover body. The opening and closing element includes an opening and closing portion. Changes of air pressures inside and outside the detergent additive box open or close the opening and closing portion, the air vent implements unidirectional ventilation or is closed.

The cover body includes a first cover body for rigid supporting and a second cover body for flexible sealing. The second cover body is sleeved on a lower end of the first cover body and cooperates with the first cover body to detachably and hermetically mount the liquid inlet cover at the liquid inlet.

The first cover body and the second cover body are made of the same material or two materials. The first cover body and the second cover body are integrated molding or integrated molding through double-material injection molding or formed through secondary injection molding or clasped connection or adhered connection or in threaded connection. Preferably, the size of the upper end of the first cover body is greater than the maximum size of the second cover body. A side wall of the second cover body is provided with a groove for clamping the liquid inlet of the box body, and a transition portion favorable for installation is also arranged on the outer side of the bottom of the second cover body. The groove in the side wall of the second cover body is matched with the liquid inlet to hermetically clamp the liquid inlet cover to the liquid inlet, and the transition portion arranged on the outer side of the bottom of the second cover body and favorable for installation is a slope or a smooth curved surface extending from the bottom to the outside. A recess suitable for being clasped is arranged at the bottom of the side wall of the upper end of the first cover body. Preferably, the recess arranged at the bottom of the side wall of the upper end of the first cover body is a tilting planar recess or a tilting smooth recess from the side wall of the first cover body to the bottom of the first cover body. Preferably, the second cover body is an integrated molding elastic material element. A non-smooth connection portion is arranged at the lower end of the first cover body. The connection portion is matched with the second cover body to enhance the connection strength of the first cover body and the second cover body.

At least one air vent penetrating the upper end surface and the lower end surface of the first cover body is formed in the first cover body, and a connection hole connected with the opening and closing element and a ring groove assisting in sealing the opening and closing element are also coaxially formed in the first cover body. The ring groove is arranged on the lower end surface of the first cover body, and an air outlet of the air vent is formed in the lower end surface within the ring groove. Preferably, at least one air vent penetrating the upper end surface and the lower end surface of the first cover body is formed in the first cover body, and the air outlet of the air vent is uniformly distributed circumferentially on the lower end surface. The air vent is set to realize ventilation. The preferable uniformly-circumferential distribution of the air vent is to prevent such a situation that the air vents may not be reset and closed, which due to an extremely large local opening degree of the opening and closing portion caused by non-uniform distribution of the air vents. Preferably, the connection hole and the ring groove are coaxially arranged, and the air vents are uniformly circumferentially arranged around an axis of the connection hole, so as to prevent a failure, caused by non-uniform distribution of the air vents, in closing and resetting the opening and closing portion after the opening and closing portion is completely opened. A locking boss for clamping the opening and closing element is formed in the connection hole. Preferably, the inner side wall of the ring groove tilts towards the air vents. More preferably, the inner side wall of the ring groove extends to outer edges of the air vents in a tilting transition manner, thereby enhancing the sealing effect on the opening and closing portion.

The box body is provided with a mounting recess for mounting the liquid inlet cover and a clasping position. The mounting recess extends from the liquid inlet to the outside, and a shape of the mounting recess matches with the upper end of the first cover body. The clasping position is a portion additionally extends from one end of the mounting recess to the outside and suitable for being clasped. A guide portion favorable for mounting the liquid inlet cover is also arranged at the liquid inlet, the guide portion is matched with the transition portion of the second cover body. The mounting recess for mounting the liquid inlet cover enables the mounted liquid inlet cover to be flush with or sunken into the box body of the detergent additive box, so as to avoid it from protruding from the detergent additive box and play a role of limited mounting at the same time. The clasping position is convenient for detaching or mounting the detergent additive box. Preferably, the clasping position is a semicircular recess, additionally extending to the outside, of one end of the mounting recess. Further, the opening and closing element is an elastic material element, and includes the opening and closing portion and a connection transition section connected with the connection hole of the first cover body. Preferably, the opening and closing element is an integrated molding elastic material element.

The opening and closing portion is of an inverted umbrella-shaped structure or an inverted conical structure, and the opening and closing portion covers the lower end surface of the first cover body, and keeps the original shape or deforms to make the tail end extend into or leave the ring groove to close or open the air vent. A hollow hole for assisting the deformation of the opening and closing portion is formed inside the connection transition section. The opening and closing portion of the opening and closing element is made of an elastic material, so that it correspondingly deforms under the action of certain pressure, and may restore the original shape after the pressure is removed. The opening and closing portion and the connection portion are in threaded connection or clasped connection or adhered connection or integrated molding. Preferably, they are integrated molding. The opening and closing portion is set to be of the inverted umbrella-shaped structure or the inverted conical structure in order to make the opening and closing portion deform under certain unidirectional pressure and have higher restoring force thanks to its own structure after the deformation. When the opening and closing portion is closed, the tail end of the opening and closing portion extends into the ring groove to seal the air vent. When the opening and closing portion is opened, the opening and closing portion deforms, the tail end of the opening and closing portion leaves the ring groove, and the air vent implements unidirectional ventilation. Preferably, the connection transition section is provided with a ring-form boss and a transition section. The ring-form boss cooperates with a locking boss in the connection hole to clamp the connection portion into the connection hole. Preferably, the ring-form boss has a semicircular cross section in order to clamp the opening and closing element onto the locking boss of the connection hole more conveniently and quickly with less effort. The hollow hole formed inside the connection transition section extends and passes through the opening and closing portion, so as to further reduce the force for the deformation of the opening and closing portion.

Further, a detergent additive box with a liquid inlet cover includes a liquid outlet. The detergent additive box has two states. In a first state, a detergent additive is pumped from the liquid outlet, so air pressure in the detergent additive box is reduced to be less than air pressure outside, and the opening and closing portion deforms, the tail end of the opening and closing portion leaves the ring groove, and air flows in through the air vent. In a second state, when the pumping is stopped, the liquid outlet is sealed, so air pressure in the detergent additive box is equal to the air pressure outside, and the opening and closing portion restores original shape, the tail end of the opening and closing portion extends into the ring groove to seal the detergent additive box.

A detergent additive box with a sealing structure includes a box body, a liquid outlet and the sealing structure. The sealing structure includes an unidirectional ventilation structure and a sealing element arranged in the liquid outlet. The unidirectional ventilation structure is hermetically mounted on the box body. Changes of air pressures inside and outside the detergent additive box open the structure to implement unidirectional ventilation or close the structure. An opening is also formed in the box body, and the unidirectional ventilation structure is hermetically arranged in the opening.

The unidirectional ventilation structure includes a ventilation element and an opening and closing element. At least one air vent is formed in the ventilation element. The opening and closing element includes an opening and closing portion. Changes of air pressures inside and outside the detergent additive box open and close the opening and closing portion, the air vent implements unidirectional ventilation or is closed. The opening and closing element is detachably connected into the ventilation element, and the opening and closing portion covers the air outlet of the air vent. The opening and closing portion is of an inverted umbrella-shaped or an inverted conical structure.

The air vent is opened or closed according to deformation or restoration of the opening and closing portion. A liquid inlet is also arranged on the box body. A liquid inlet cover is detachably and hermetically arranged at the liquid inlet, and the liquid inlet cover is of an unidirectional ventilation structure. The liquid inlet cover includes a cover body and an opening and closing element. The cover body includes a first cover body for rigid supporting and a second cover body for flexible sealing. The second cover body is sleeved on a lower end of the first cover body. The opening and closing element is detachably connected into the first cover body. At least one air vent is arranged on the first cover body. The opening and closing element includes an opening and closing portion. The opening and closing portion covers an air outlet of the air vent. The opening and closing portion is of an inverted umbrella-shaped or an inverted conical structure. Changes of air pressures inside and outside the detergent additive box open or close the opening and closing portion, the opening and closing portion deforms or keeps the original shape and the air vent implements unidirectional ventilation or is closed. A groove for clamping the liquid inlet of the box body is formed in the side wall of the second cover body, and cooperates with the first cover body to detachably and hermetically mount the liquid inlet cover at the liquid inlet. The detergent additive box has two states. In a first state, a detergent additive is pumped from the liquid outlet, air pressure in the detergent additive box is reduced to be less than air pressure outside, and the opening and closing portion deforms to be opened, and air flows in through the air vent. In a second state, when pumping of the detergent additive is stopped, the liquid outlet is sealed, so air pressure in the detergent additive box is equal to air pressure outside, and the opening and closing portion restores original shape to be closed, and the air vent and the detergent additive box are sealed. The liquid outlet communicates with a draining pipeline of a washing machine to drain a detergent additive into a washing cavity of the washing machine. An on-off valve is arranged on the liquid outlet, and includes a drainage channel. A sealing element is arranged in the liquid outlet or in the drainage channel of the on-off valve, and the sealing element is used for sealing a joint of the liquid outlet and the draining pipeline.

Further, the liquid outlet device includes an on-off valve arranged at the liquid outlet and a suction device arranged in the detergent additive box. An inlet of the suction device communicates with the detergent additive box, and an outlet of the suction device communicates with an inlet of the on-off valve.

Preferably, the suction device extends to the bottom wall of the detergent additive box, and the inlet of the suction device faces the bottom wall of the detergent additive box and is spaced from the bottom wall by a gap used for allowing liquid to pass. By the arrangement of the suction device, the inlet of the suction device faces the bottom wall of the detergent additive box and is spaced from the bottom wall by the gap used for allowing liquid to pass, so that the detergent additive in the detergent additive box may be sucked completely without causing any waste.

Preferably, a portion, corresponding to the inlet of the suction device, on the bottom wall of the detergent additive box is sunken inwards to form a groove located lower than the surface of the bottom wall of the detergent additive box. The inlet of the suction device is located in the groove, and a gap used for allowing liquid to pass is reserved among the inlet and the bottom surface and the side wall of the groove. The groove formed by inwards sinking the portion on the bottom wall of the detergent additive box, corresponding to the inlet of the suction device, and located lower than the surface of the bottom wall of the detergent additive box plays a role of aggregating the detergent additive when there is a few of the detergent additive remaining.

Furthermore, the inlet of the suction device is located in the groove, so that the detergent additive may be fully used and saved as much as possible, without causing any waste.

Further, the suction device is of a hollow tubular structure, inside which a runner is formed. One end of the runner faces the bottom wall of the detergent additive box, and the other end communicates with the inlet of the on-off valve. An arc-shaped reverse diversion channel is formed on the runner from an inlet to an outlet of the runner. A reverse point, corresponding to the inlet of the on-off valve, on the runner is an outwards extended arc surface. Preferably, the radius of the arc surface is greater than that of the runner. Since the reverse point, corresponding to the inlet of the on-off valve, on the runner is the outwards extended arc surface, it is favorable for the flowing of the detergent additive in the runner, which is compared to using a right angle or a corner similar to the right angle at the reverse point. In the present disclosure, the outwards extended arc surface at the reverse point is favorable for flowing of liquid, instead of generating intermittent flowing.

Further, the on-off valve includes a drainage channel, and a piston and a reset spring which are arranged in the drainage channel. The piston blocks the drainage channel under the action of the reset spring. The sealing element is arranged in the liquid outlet or in the drainage channel of the on-off valve, and is used for sealing the joint of the liquid outlet and the draining pipeline.

Preferably, the on-off valve includes the drainage channel and the piston arranged in the drainage channel. A gap used for allowing liquid to flow is reserved between the outer wall of the piston and the inner wall of the drainage channel. The outlet end of the drainage channel is provided with a narrowed section. The piston squeezes the narrowed section under the action of the reset spring to close the drainage channel. Preferably, the on-off valve includes the drainage channel and the piston arranged in the drainage channel. A gap used for allowing liquid to flow is reserved between the outer wall of the piston and the inner wall of the drainage channel. The outlet end of the drainage channel is provided with a narrowed section. The piston squeezes the narrowed section under the action of the reset spring to close the drainage channel. Preferably, the liquid outlet communicates with the draining pipeline of the washing machine to drain the detergent additive into the washing cavity of the washing machine. A connecting structure is arranged on the draining pipeline, and is used for opening the on-off valve when the liquid outlet communicates with the draining pipeline. The connecting structure may be set as a protruding structure or have a protruding structure. The protruding structure may extend into the liquid outlet and cooperate with the piston. The protruding structure jacks away the piston to open the on-off valve. Preferably, the connecting structure is arranged at the end portion of the draining pipeline, and opens the on-off valve by jacking the piston. The connecting structure is of a columnar structure, inside which a runner is formed. One end of the connecting structure cooperates with the detergent additive box to open the on-off valve, and the other end communicates with the draining pipeline of the washing machine. A hole communicating with the runner in the connecting structure is formed in the side wall of the end cooperating with the detergent additive box, so that when the end portion pushes away the piston, the detergent additive is drained by the hole into the runner of the connecting structure, and then enters the washing machine through the draining pipeline. Preferably, the detergent additive box is of a cube or cuboid structure, and the liquid outlet is flush with the outer surface of the detergent additive box. Of course, the liquid outlet may also protrude from the surface of the detergent additive box. In order to reduce the machining difficulty and simplify the structure of a mounting cavity for accommodating the detergent additive box, the detergent additive box is preferably designed to be a regular cube or cuboid, and the liquid outlet is flush with the outer surface of the detergent additive box. Preferably, the liquid outlet is formed in the side wall of the detergent additive box, and the connecting structure corresponding to the liquid outlet is horizontally arranged, or the liquid outlet is formed in the bottom wall of the detergent additive box, and the connecting structure corresponding to the liquid outlet is vertically arranged.

Further, the box body further includes a first limiting structure. The shape, size and position of the first limiting structure are matched with a second limiting structure on the mounting cavity of the detergent additive box to limit the activity of the mounted detergent additive box.

In the above solution, the second limiting structure is arranged in the mounting cavity of the detergent additive box, and is used for limiting the activity of the detergent additive box when the detergent additive box is arranged on the mounting cavity, so as to detachably fixedly mount the detergent additive box in the mounting cavity of the detergent additive box.

The second limiting structure includes an elastic piece arranged on one side of the mounting cavity. When the detergent additive box is arranged on the mounting cavity, the elastic piece is arranged between the detergent additive box and the side wall of the mounting cavity in an elastic deformation manner. The second limiting structure further includes at least one separation rib arranged on the bottom wall of the mounting cavity and used for separating various detergent additive boxes. Preferably, the separation rib and the elastic piece are arranged in the same direction. The separation rib limits the activity of the detergent additive box in a first direction, and the elastic piece limits the activity of the detergent additive box in a second direction perpendicular to the first direction.

Preferably, the detergent additive box is of a cuboid/cube structure, and is detachably fixedly mounted in the mounting cavity of the detergent additive box.

Further, the box body further includes a protruding structure arranged on the upper side of a side wall for mounting of the box body for increasing a friction force. Therefore, the friction force during removal of the box body is increased to make the removal more convenient and save effort. Preferably, the protruding structure is at least one parallel cuboid/cube protrusion having a smooth edge, or is a plurality of scattered round protrusions. The position of the protruding structure is matched with the clasping position of the mounting cavity of the detergent additive box, which facilitates the removal of the detergent additive box and increases the friction force.

The present disclosure further provides a washing machine, including the above-mentioned detergent additive box.

Compared with the prior art, by the adoption of the above technical solutions, the present disclosure has the following beneficial effects.

1. Air is circulated unidirectionally to balance the air pressure in the detergent additive box, so that the detergent additive is pumped out more smoothly, and the increase of the difficulty in pumping out the detergent additive due to the reduction of the pressure in the detergent additive box is avoided.

2. Automatic drainage and multi-time drainage may be realized, and the detergent additive box does not need to be mounted at each time of washing.

3. The detergent additive box is sealed, and only air can enter it; and air and liquid cannot flow out from the detergent additive box, thereby playing roles of sealing, waterproofing, dust prevention and prevention of liquid overflow.

4. Since the detergent additive may be supplemented, the detergent additive box may be cyclically used, which saves the cost, saves the energy, protects the environment and is convenient to use.

5. The detergent additive box is simple in structure, convenient to mount and good in usability.

6. The structures and the materials are simple, and the economy is good. The specific implementations of the present disclosure are further described below in detail in combination with the accompanying drawings.

BRIEF DESCRIPTION OF THE DRAWINGS

The drawings constitute one part of this application, and are used to provide a further understanding of the present disclosure. Illustrative embodiments and descriptions thereof of the present disclosure are used to explain the present disclosure, and do not constitute an improper limitation to the present disclosure. Obviously, the drawings described below are only some embodiments, and those skilled in the art can obtain other drawings according to these drawings without paying any creative work. In the drawings.

Figure 1:
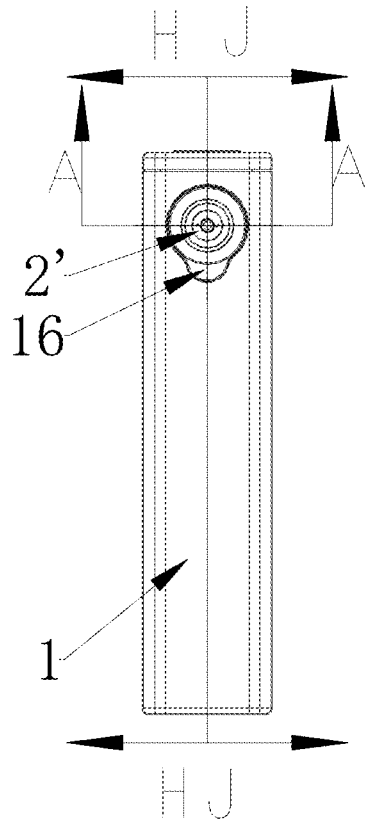
FIG. 1 is a schematic diagram of a detergent additive box of the present disclosure.

In the drawings: 1: detergent additive box/box body; 11: protruding structure; 12: liquid outlet; 14: liquid inlet; 141: guide portion; 15: mounting recess; 16: clasping position; 17: limiting structure; 2: unidirectional ventilation structure; 21: ventilation element; 211: air vent; 212: connection hole; 2121: locking boss; 213: ring groove; 22: opening and closing element; 221: opening and closing portion; 222: connection portion; 2221: ring-form boss; 2222: transition section; 2223: hollow hole; 2': liquid inlet cover; 21': first cover body; 211': air vent; 212': connection hole; 2121': locking boss; 213': ring groove; 214': recess; 215': connection portion; 22': opening and closing element; 221': opening and closing portion; 222': connection transition section; 2221': ring-form boss; 2223': hollow hole; 23': second cover body; 231': groove; 232': transition portion; 3: suction device; 41: sealing element; 5: on-off valve; 51: reset spring; and 52: piston.

It should be noted that these drawings and text descriptions are not intended to limit the conceptual scope of the present disclosure in any form, but are to describe the concept of the present disclosure to those skilled in the art with reference to specific embodiments.

DETAILED DESCRIPTION

Figure 2:
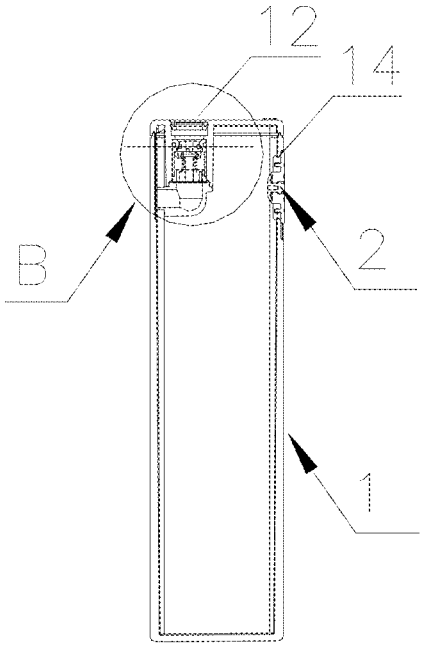
FIG. 2 is a cross-sectional diagram along a direction J-J of FIG. 1.
Figure 3:
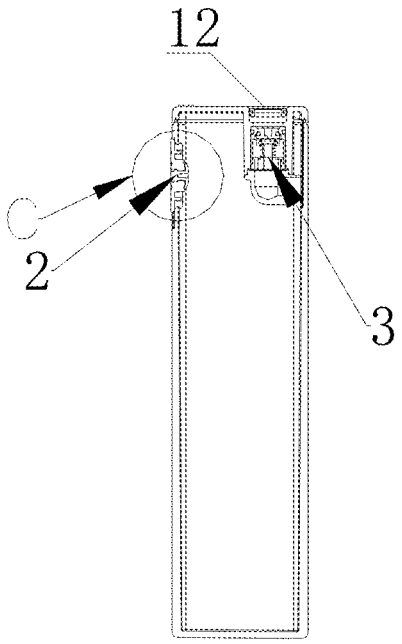
FIG. 3 is a cross-sectional diagram along a direction H-H of FIG. 1.
Figure 4:
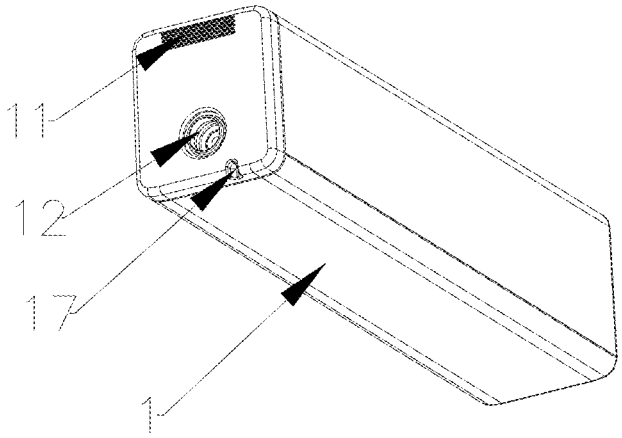
FIG. 4 is a three-dimensional diagram of a detergent additive box of the present disclosure.
Figure 5:
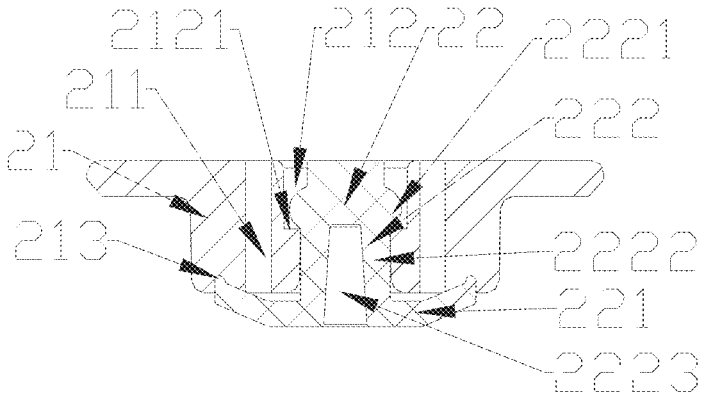
FIG. 5 is a cross-sectional diagram of an unidirectional ventilation structure according to an embodiment I of the present disclosure.
Figure 6:
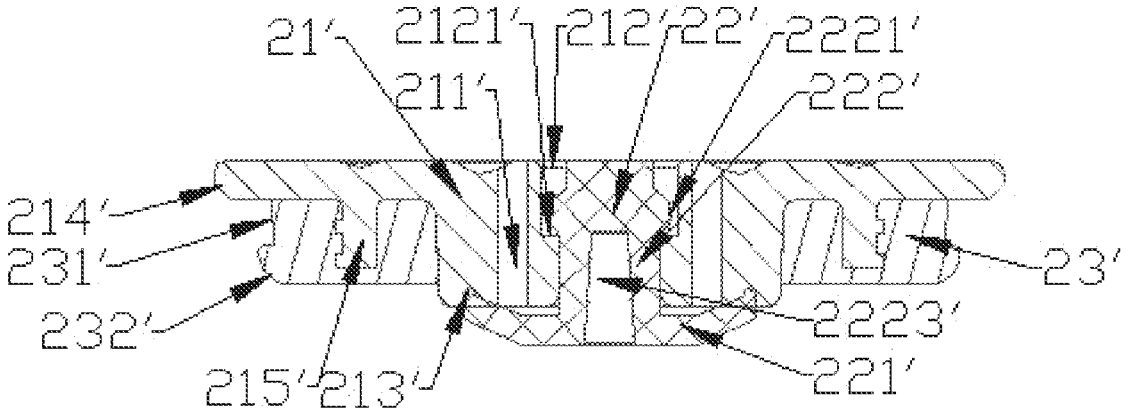
FIG. 6 is a cross-sectional diagram of a liquid inlet cover shown in FIG. 1 of the present disclosure along A-A.
Figure 7:
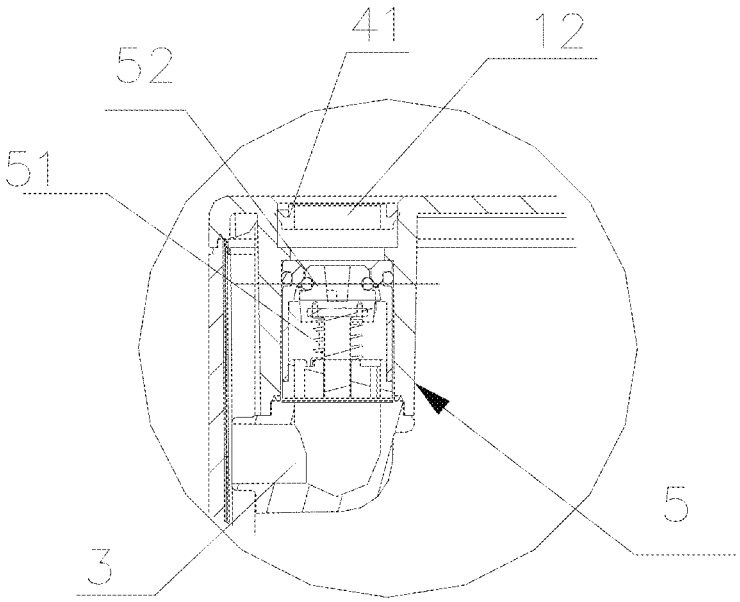
FIG. 7 is an enlarged diagram of a portion B of FIG. 2.
Figure 8:
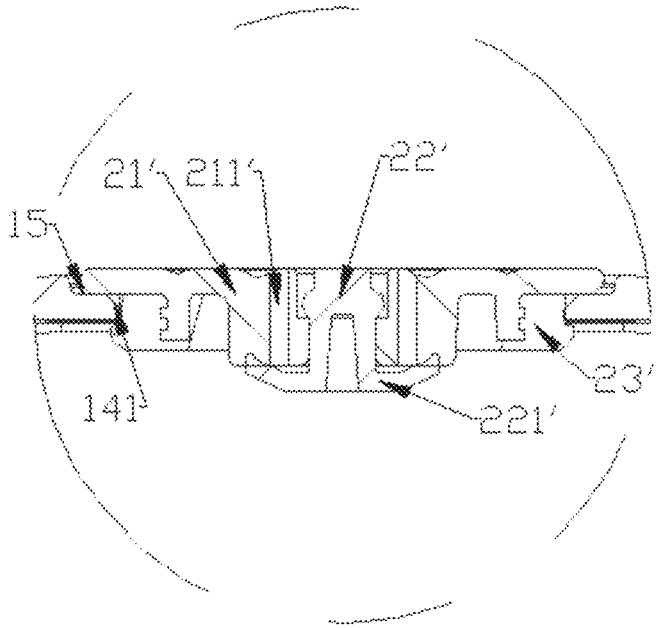
FIG. 8 is an enlarged diagram of a portion C of FIG. 3.

The specific implementations of the present disclosure are further described below in combination with the accompanying drawings. As shown in FIGS. 1 to 8, a detergent additive box 1 includes:

a box body 1, which is a closed box body 1 having a cavity inside, wherein a liquid outlet 12 is formed in the box body 1, and the liquid outlet communicates with a draining pipeline of a washing machine to drain a detergent additive into a washing cavity of the washing machine;

an unidirectional ventilation structure, used for balancing air pressures inside and outside the detergent additive box;

a liquid outlet device, wherein the detergent additive stores the cavity inside the box body, and the detergent additive enters the draining pipeline of the washing machine from the detergent additive box through the liquid outlet device.

The unidirectional ventilation structure is arranged on the box body. The structure is opened to implement unidirectional ventilation or closed to seal the detergent additive box 1 according to changes of air pressures inside and outside the detergent additive box 1. The whole detergent additive box 1 is a sealed box body, and the unidirectional ventilation structure only allows the box body 1 to be ventilated unidirectionally, so that liquid, impurities and the like may not be circulated on two sides of the carrier through the unidirectional ventilation structure. The unidirectional ventilation structure ventilates unidirectionally and also plays a role of sealing the box body.

The liquid outlet device includes an on-off valve 5 arranged at the liquid outlet and a suction device 3 arranged in the detergent additive box. An inlet of the suction device 3 communicates with the detergent additive box 1, and an outlet of the suction device communicates with an inlet of the on-off valve 5.

The box body 1 further includes a first limiting structure 17. The shape, size and position of the first limiting structure 17 are matched with a second limiting structure on a mounting cavity of the detergent additive box to limit the activity of the mounted detergent additive box.

Preferably, the detergent additive box is of a cuboid/cube structure, and is detachably fixedly mounted in the mounting cavity of the detergent additive box.

The box body 1 further includes a protruding structure 11 arranged on the upper side of the side wall for mounting of the box body for increasing a friction force.

In the above solution, the detergent additive box 1 is a sealed box body 1 having the cavity inside, and is provided with the liquid outlet 12. The detergent additive is arranged in the cavity inside the box body. The draining pipeline of the washing machine communicates with the liquid outlet and pumps the detergent additive in the detergent additive box. The detergent additive enters the draining pipeline of the washing machine from the liquid outlet 12 through the liquid outlet device. In the pumping process, the air pressures inside and outside the detergent additive box are balanced through the ventilation structure to keep the pumping smooth all the time.

The washing machine of the present disclosure includes the above-mentioned detergent additive box 1.

Embodiment I

As shown in FIGS. 1 to 8, the present embodiment, a detergent additive box 1 includes:

a box body 1, which is a closed box body 1 having a cavity inside, wherein a liquid outlet 12 is formed in the box body 1, and the liquid outlet communicates with a draining pipeline of a washing machine to drain a detergent additive into a washing cavity of the washing machine;

an unidirectional ventilation structure, used for balancing air pressures inside and outside the detergent additive box;

a liquid outlet device, wherein the detergent additive stores the cavity inside the box body, and the detergent additive enters the draining pipeline of the washing machine from the detergent additive box through the liquid outlet device.

The unidirectional ventilation structure is arranged on the box body. The structure is opened to implement unidirectional ventilation or closed to seal the detergent additive box 1 according to changes of air pressures inside and outside the detergent additive box 1. The whole detergent additive box 1 is a sealed box body, and the unidirectional ventilation structure only allows the box body 1 to be ventilated unidirectionally, so that liquid, impurities and the like may not be circulated on two sides of a carrier through the unidirectional ventilation structure. The unidirectional ventilation structure ventilates unidirectionally and also plays a role of sealing the box body.

As shown in FIGS. 1 to 5, an opening is formed in the box body, and the unidirectional ventilation structure is hermetically arranged in the opening. The unidirectional ventilation structure includes a ventilation element 21 and an opening and closing element 22. An air vent 211 is formed in the ventilation element 21. The opening and closing element 22 includes an opening and closing portion. When the opening and closing portion 221 is opened or closed according to changes of air pressures on two sides of the carrier, the air vent 211 implements unidirectional ventilation or is closed.

Two air vents 211 are formed in the ventilation element 21, and the air vents penetrate an upper end surface and a lower end surface of the ventilation element 21. Air outlets of the air vents 211 are uniformly distributed circumferentially on the lower end surface.

The ventilation element 21 is composed of two integrated molding coaxial cylindrical structures having different diameters, and the diameter of the upper end surface of the ventilation element 21 is slightly greater than that of the lower end surface.

A connection hole 212 connected to the opening and closing element 22 and a ring groove 213 assisted in sealing the opening and closing element 22 are also coaxially arranged on the ventilation element 21.

The connection hole 212 passes through the ventilation element 21, and is coaxial with the ventilation element 21. The connection hole 212 includes two coaxial holes having different diameters. A locking boss 2121 for clamping the opening and closing element 22 is formed at a joint of the two holes. The air vents 211 are uniformly circumferentially arranged around an axis of the connection hole 212.

The ring groove 213 is formed in the lower end surface of the ventilation element 21. The air outlets of the air vents 211 are formed in the lower end surface within the ring groove 213. The inner side wall of the ring groove 213 tilts towards the air vents 211, and extends to outer edges of the air vents 211 in a transition manner. The outer side wall of the ring groove 213 is a vertical edge, and the two side walls of the ring groove 213 are in smooth intersection.

The opening and closing element 22 is an integrated molding elastic material element, and includes the opening and closing portion 221 and a connection portion 222.

The opening and closing portion 221 is of an inverted umbrella-shaped structure, which covers the lower end surface of the ventilation element 21, and the tail end of the opening and closing portion 221' extends into the ring groove 213.

When the opening and closing portion 221 is closed, the tail end of the opening and closing portion extends into the ring groove 213 to seal the air vents 211. When the opening and closing portion is opened, the opening and closing portion 221 deforms, the tail end of the opening and closing portion leaves the ring groove 213, and the air vents 211 implement unidirectional ventilation.

The connection portion 222 is provided with a ring-form boss 2221 and a transition section 2222. The ring-form boss 2221 cooperates with the locking boss 2121 on the connection hole 212 to clamp the connection portion 222 in the connection hole 212. The transition section 2222 is arranged between the ring-form boss 2221 and the opening and closing portion 221. A hollow hole 2223 for assisting the deformation of the opening and closing portion 221 is arranged in the transition section 2222.

Preferably, the ring-form boss 2221 has a semicircular cross section. The hollow hole 2223 formed inside the transition section 2222 extends and passes through the opening and closing portion 221 to further reduce the force for the deformation of the opening and closing portion 221.

The detergent additive box 1 in the present embodiment includes the liquid outlet 12, and further includes the above-mentioned unidirectional ventilation structure 2. The detergent additive box 1 has two states. In a first state, a detergent additive is pumped from the liquid outlet 12, air pressure in the detergent additive box 1 is reduced to be less than air pressure outside, and the opening and closing portion 221 deforms, the tail end of the opening and closing portion leaves the ring groove 213, and air flows in through the air vents 211. In a second state, when pumping of the detergent additive is stopped, the liquid outlet 12 is sealed, so air pressure in the detergent additive box 1 is equal to the air pressure outside, and the opening and closing portion 221 restores original shape, the tail end of the opening and closing portion extends into the ring groove 213 to seal the detergent additive box 1.

Embodiment II

As shown in FIGS. 1 to 8, the present embodiment, a detergent additive box 1 includes:

a box body 1, which is a closed box body 1 having a cavity inside, wherein a liquid outlet 12 is formed in the box body 1, and the liquid outlet communicates with a draining pipeline of a washing machine to drain a detergent additive into a washing cavity of the washing machine;

an unidirectional ventilation structure, used for balancing air pressures inside and outside the detergent additive box;

a liquid outlet device, wherein the detergent additive stores the cavity inside the box body, and the detergent additive enters the draining pipeline of the washing machine from the detergent additive box through the liquid outlet device.

The unidirectional ventilation structure is arranged on the box body. The structure is opened to implement unidirectional ventilation or closed to seal the detergent additive box 1 according to changes of air pressures inside and outside the detergent additive box 1. The whole detergent additive box 1 is a sealed box body, and the unidirectional ventilation structure only allows the box body 1 to be ventilated unidirectionally, so that liquid, impurities and the like may not be circulated on two sides of a carrier through the unidirectional ventilation structure. The unidirectional ventilation structure ventilates unidirectionally and also plays a role of sealing the box body.

As shown in FIGS. 1 to 4, 6 and 8, a liquid inlet 14 is also arranged on the box body. A liquid inlet cover 2' is detachably and hermetically arranged at the liquid inlet 14, and the liquid inlet cover 2' is of an unidirectional ventilation structure.

The liquid inlet cover 2' includes a cover body and an opening and closing element 22'. Two air vents 211' are formed in the cover body. The opening and closing element 22' includes an opening and closing portion 221'. When the opening and closing portion 221' is opened or closed according to changes of air pressures inside and outside the detergent additive box 1, the air vents 211' implement unidirectional ventilation or are closed.

At least one air vent 211' is formed in the cover body, and the air vent penetrates the upper end surface and the lower end surface of the cover body. Air outlets of the air vents 211' are uniformly distributed circumferentially on the lower end surface.

The cover body includes a first cover body 21' for rigid supporting and a second cover body 23' for flexible sealing. The second cover body 23' is sleeved on a lower end of the first cover body 21' and cooperates with the first cover body 21' to detachably and hermetically mount the liquid inlet cover 2' at the liquid inlet 14.

The first cover body 21' and the second cover body 23' are made of two materials, and are in clasping connection molding.

The first cover body 21' is composed of two cylindrical structures having different diameters. The diameter of the upper end of the first cover body 21' is greater than that of the lower end. The second cover body 23' is sleeved on a lower end of the first cover body 21'. The diameter of the upper end of the first cover body 21' is greater than that of the second cover body 23'.

The side wall of the second cover body 23' is provided with a groove 231' for clamping the liquid inlet 14 of the box body, and a transition portion 232' favorable for installation is also arranged on the outer side of the bottom of the second cover body 23'.

The groove 231' is matched with the liquid inlet 14 to hermetically clamp the liquid inlet cover 2' to the liquid inlet 14, and the transition portion 232' arranged on the outer side of the bottom of the second cover body 23' and favorable for installation is a slope extending from the bottom to the outside. A recess 214' suitable for being clasped is arranged at the bottom of the side wall of the upper end of the first cover body 21', and is a tilting planar recess 214' from the side wall of the first cover body 21' to the bottom.

The second cover body 23' is an integrated molding elastic material element. A non-smooth connection portion 215' is arranged at the lower end of the first cover body 21'. The connection portion 215' is matched with the second cover body 23' to enhance the connection strength of the first cover body 21' and the second cover body 23'.

Two air vents 211' penetrating the upper end surface and the lower end surface of the first cover body are formed in the first cover body 21', and a connection hole 212' connected with the opening and closing element 22' and a ring groove 213' assisting in sealing the opening and closing element 22' are also coaxially formed in the first cover body 21'. The ring groove 213' is arranged on the lower end surface of the first cover body 21', and air outlets of the air vents 211' are formed in the lower end surface within the ring groove 213'.

The air outlets of the air vents 211' are uniformly distributed circumferentially on the lower end surface.

The connection hole 212' and the ring groove 213' are coaxially arranged, and the air vents 211' are uniformly circumferentially arranged around an axis of the connection hole 212'.

A locking boss 2121' for clamping the opening and closing element 22' is formed in the connection hole 212'.

Preferably, the inner side wall of the ring groove 213' tilts towards the air vents 211'. More preferably, the inner side wall of the ring groove 213' extends to outer edges of the air vents 211' in a tilting transition manner, thereby enhancing the sealing effect on the opening and closing portion 221'. The box body is provided with a mounting recess 15 for mounting the liquid inlet cover 2' and a clasping position 16. The mounting recess 15 extends from the liquid inlet 14 to the outside, and a shape of the mounting recess matches with the upper end of the first cover body 21'. The clasping position 16 is a semicircular mounting recess 15 additionally extends to the outside from one end of the mounting recess 15. A guide portion 141 favorable for mounting the liquid inlet cover 2' is also arranged at the liquid inlet 14, the guide portion is matched with the transition portion 232' of the second cover body 23'.

The opening and closing element 22' is an integrated elastic material element, and includes the opening and closing portion 221' and a connection transition section 222' connected with the connection hole 212' of the first cover body 21'.

The opening and closing portion 221' is of an inverted umbrella-shaped structure or an inverted conical structure, and the opening and closing portion 221' covers the lower end surface of the first cover body 21', and keeps the original shape or deforms to make the tail end of the opening and closing portion 221' extend into or leave the ring groove 213' to close or open the air vents 211'. A hollow hole 2223' for assisting the deformation of the opening and closing portion 221' is formed inside the connection transition section 222'.

The opening and closing portion 221' of the opening and closing element 22' is made of an elastic material, and the opening and closing portion 221' and the connection portion 215' are integrated molding. The opening and closing portion 221' is of an inverted umbrella-shaped structure.

When the opening and closing portion 221' is closed, the tail end of the opening and closing portion extends into the ring groove 213' to seal the air vents 211'. When the opening and closing portion is opened, the opening and closing portion 221' deforms, the tail end of the opening and closing portion leaves the ring groove 213', and the air vents 211' implement unidirectional ventilation.

The connection transition section 222' is provided with a ring-form boss 2221' and a transition section. The ring-form boss 2221' cooperates with a locking boss 2121' on the connection hole 212' to clamp the connection portion 215' into the connection hole 212'. The ring-form boss 2221' has a semicircular cross section, and the hollow hole 2223' formed inside the connection transition section 222' extends and passes through the opening and closing portion 221'.

The detergent additive box 1 with the liquid inlet cover 2' includes the liquid outlet 12. The detergent additive box 1 has two states. In a first state, a detergent additive is pumped from the liquid outlet 12, air pressure in the detergent additive box 1 is reduced to be less than air pressure outside, and the opening and closing portion 221' deforms, the tail end of the opening and closing portion leaves the ring groove 213', and air flows in through the air vents 211'. In a second state, when pumping of the detergent additive is stopped, the liquid outlet 12 is sealed, so air pressure in the detergent additive box is equal to the air pressure outside, and the opening and closing portion 221' restores original shape, the tail end of the opening and closing portion extends into the ring groove 213' to seal the detergent additive box 1.

Embodiment III

As shown in FIGS. 1 to 8, a detergent additive box 1 includes:

a box body 1, which is a closed box body 1 having a cavity inside, wherein a liquid outlet 12 is formed in the box body 1, and the liquid outlet communicates with a draining pipeline of a washing machine to drain a detergent additive into a washing cavity of the washing machine;

an unidirectional ventilation structure, used for balancing air pressures inside and outside the detergent additive box;

a liquid outlet device, wherein the detergent additive stores the cavity inside the box body, and the detergent additive enters the draining pipeline of the washing machine from the detergent additive box through the liquid outlet device.

The liquid outlet device includes an on-off valve arranged at the liquid outlet 12 and a suction device arranged in the detergent additive box. An inlet of the suction device communicates with the detergent additive box, and an outlet of the suction device communicates with an inlet of the on-off valve.

As shown in FIGS. 1 to 4 and 7, the suction device 3 extends to the bottom wall of the detergent additive box 1, and the inlet of the suction device 3 faces the bottom wall of the detergent additive box 1, and is spaced from the bottom wall by a gap used for allowing liquid to pass.

In the present embodiment, by the arrangement of the suction device 3, the inlet of the suction device 3 faces the bottom wall of the detergent additive box 1, and is spaced from the bottom wall by the gap used for allowing liquid to pass, so that the detergent additive in the detergent additive box 1 may be sucked completely without causing any waste. Preferably, a portion, corresponding to the inlet of the suction device 3, on the bottom wall of the detergent additive box 1 is sunken inwards to form a groove located lower than the surface of the bottom wall of the detergent additive box 1. The inlet of the suction device 3 is located in the groove, and the gap used for allowing liquid to pass is reserved among the inlet and the bottom surface and the side wall of the groove. In the present embodiment, the groove formed by inwards sinking the portion on the bottom wall of the detergent additive box, corresponding to the inlet of the suction device 3, and located lower than the surface of the bottom wall of the detergent additive box 1 plays a role of aggregating the detergent additive when there is a little detergent additive remaining. Furthermore, the inlet of the suction device is located in the groove, so that the detergent additive may be fully used and saved as much as possible, without causing any waste.

Furthermore, the suction device 3 is of a hollow tubular structure, inside which a runner is formed. One end of the runner faces the bottom wall of the detergent additive box 1, and the other end communicates with the inlet of the on-off valve 5. An arc-shaped reverse diversion channel is formed on the runner from an inlet to an outlet of the runner. A reverse point, corresponding to the inlet of the on-off valve 5, on the runner is an outwards extended arc surface. Preferably, the radius of the arc surface is greater than that of the runner. Since the reverse point, corresponding to the inlet of the on-off valve 5, on the runner is the outwards extended arc surface, it is favorable for the flowing of the detergent additive in the runner, which is compared to using a right angle or a corner similar to the right angle at the reverse point. In the present disclosure, the outwards extended arc surface at the reverse point is favorable for flowing of liquid, instead of generating intermittent flowing.

Preferably, the on-off valve 5 includes a drainage channel, and a piston 52 and a reset spring 51 which are arranged in the drainage channel. The piston 52 blocks the drainage channel under the action of the reset spring 51.

Preferably, the on-off valve 5 includes the drainage channel and the piston 52 arranged in the drainage channel. A gap used for allowing liquid to flow is reserved between the outer wall of the piston 52 and the inner wall of the drainage channel. The outlet end of the drainage channel is provided with a narrowed section. The piston 52 squeezes the narrowed section under the action of the reset spring 51 to close the drainage channel.

Preferably, the liquid outlet 12 communicates with the draining pipeline of the washing machine to drain the detergent additive into the washing cavity of the washing machine. A connecting structure is arranged on the draining pipeline, and is used for opening the on-off valve 5 when the liquid outlet 12 communicates with the draining pipeline.

In the present embodiment, the connecting structure may be set as a protruding structure or have a protruding structure. The protruding structure may extend into the liquid outlet 12 and cooperate with the piston 52. The protruding structure jacks away the piston 52 to open the on-off valve 5.

Preferably, the connecting structure is arranged at the end portion of the draining pipeline, and opens the on-off valve 5 by jacking the piston 52. A sealing ring 41 is arranged in the liquid outlet 12 or the drainage channel of the on-off valve 5, and the sealing element is used for sealing a joint of the liquid outlet 12 and the draining pipeline.

In the above solution, the connecting structure is of a columnar structure, inside which a runner is formed. One end of the connecting structure cooperates with the detergent additive box 1 to open the on-off valve 5, and the other end communicates with the draining pipeline of the washing machine. A hole communicating with the runner in the connecting structure is formed in the side wall of the end cooperating with the detergent additive box 1, so that when the end portion pushes away the piston 52, the detergent additive is drained by the hole into the runner of the connecting structure, and then enters the washing machine through the draining pipeline.

Preferably, the detergent additive box 1 is of a cube or cuboid structure, and the liquid outlet 12 is flush with the outer surface of the detergent additive box 1. Of course, the liquid outlet 12 may also protrude from the surface of the detergent additive box 1. In order to reduce the machining difficulty and simplify the structure of a mounting cavity for accommodating the detergent additive box 1, the detergent additive box 1 is preferably designed to be a regular cube or cuboid, and the liquid outlet 12 is flush with the outer surface of the detergent additive box 1.

Embodiment IV

As shown in FIGS. 1 to 8, a detergent additive box 1 includes:

a box body 1, which is a closed box body 1 having a cavity inside, wherein a liquid outlet 12 is formed in the box body 1, and the liquid outlet communicates with a draining pipeline of a washing machine to drain a detergent additive into a washing cavity of the washing machine;

an unidirectional ventilation structure for balancing air pressures inside and outside the detergent additive box;

a liquid outlet device, wherein the detergent additive stores the cavity inside the box body, and the detergent additive enters the draining pipeline of the washing machine from the detergent additive box through the liquid outlet device.

As shown in FIGS. 1 to 4, the detergent additive box is of a cuboid/cube structure, and is detachably fixedly mounted in a mounting cavity of the detergent additive box.

The box body 1 further includes a first limiting structure 17. The shape, size and position of the first limiting structure 17 are matched with a second limiting structure on a mounting cavity of the detergent additive box to limit the activity of the mounted detergent additive box 1.

The second limiting structure is arranged in the mounting cavity of the detergent additive box, and is used for limiting the activity of the detergent additive box when the detergent additive box is arranged on the mounting cavity, so as to detachably fixedly mount the detergent additive box in the mounting cavity of the detergent additive box. The second limiting structure includes an elastic piece arranged on one side of the mounting cavity. When the detergent additive box is arranged on the mounting cavity, the elastic piece is arranged between the detergent additive box and the side wall of the mounting cavity in an elastic deformation manner. The second limiting structure further includes at least one separation rib arranged on the bottom wall of the mounting cavity and used for separating various detergent additive boxes. Preferably, the separation rib and the elastic piece are arranged in the same direction. The separation rib limits the activity of the detergent additive box in a first direction, and the elastic piece limits the activity of the detergent additive box in a second direction perpendicular to the first direction.

The box body 1 further includes a protruding structure 11 arranged on the upper side of the side wall for mounting of the box body for increasing a friction force. Therefore, the friction force during removal of the box body is increased to make the removal more convenient and save effort. Preferably, the protruding structure 11 is at least one parallel cuboid/cube protrusion having a smooth edge, or is a plurality of scattered round protrusions. The position of the protruding structure 11 is matched with the clasping position of the mounting cavity of the detergent additive box, which facilitates the removal of the detergent additive box and increases the friction force.

The above descriptions are only preferred embodiments of the present disclosure, but not intended to limit the present disclosure in any forms. Although the present disclosure is disclosed above by the preferred embodiments, the preferred embodiments are not intended to limit the present disclosure. Any person skilled in the art can make some changes by using the above-mentioned technical contents or modify the technical contents as equivalent embodiments of equivalent changes without departing from the scope of the technical solution of the present disclosure. Any simple alterations, equivalent changes and modifications that are made to the above embodiments according to the technical essence of the present disclosure without departing from the contents of the technical solution of the present disclosure shall all fall within the scope of the solution of the present disclosure.

The invention claimed is:

1. A detergent additive box, comprising:

an unidirectional ventilation structure being mounted on a carrier, wherein, the unidirectional ventilation structure includes:

a ventilation element; and an opening and closing element, wherein an air vent is formed in the ventilation element, the air vent penetrates an upper end surface and a lower end surface of the ventilation element, a connection hole connects to the opening and closing element and a ring groove for sealing the opening and closing element are coaxially arranged on the ventilation element, the opening and closing element includes an opening and closing portion and a connection portion, the connection portion is provided with a ring-form boss and a transition section, a through-hole formed inside the transition section extends and passes through the opening and closing portion, and the unidirectional ventilation structure is configured so that when air pressures on two sides of the carrier change, the opening and closing portion deforms, a tail end of the opening and closing portion leaves the ring groove, and air flows in through the air vent, and when air pressures on two sides of the carrier is equal, the opening and closing portion restores to an original shape, the tail end of the opening and closing portion extends into the ring groove, and the air vent closes.

2. The detergent additive box according to claim 1, wherein at least two air vents are formed in the ventilation element, and the opening and closing element is an elastic material element.

3. The detergent additive box according to claim 2, wherein at least one of a locking boss for clamping the opening and closing element is formed in the connection hole; and the ring groove is arranged on the lower end surface of the ventilation element, and an air outlet of the air vent is arranged on the lower end surface within the ring groove.

4. The detergent additive box according to claim 2, wherein the opening and closing portion is of an inverted conical structure, and the opening and closing portion covers a lower end surface of the ventilation element.

* * * * *